US005551654A

United States Patent [19]

McNerney

[11] Patent Number: 5,551,654

[45] Date of Patent: Sep. 3, 1996

[54] COLLAPSIBLE SUPPORT STRUCTURE FOR FLEXIBLE BAGS

[75] Inventor: Francis B. McNerney, Richmond Hill, Canada

[73] Assignee: Extrufix Inc., Pefferlaw, Canada

[21] Appl. No.: 410,295

[22] Filed: Mar. 24, 1995

[51] Int. Cl.[6] ..... B65B 67/04

[52] U.S. Cl. ..... 248/99; 248/97

[58] Field of Search ..... 248/99, 95, 97, 248/100, 101, 175

[56] References Cited

U.S. PATENT DOCUMENTS

| | | | |
|---|---|---|---|
| 3,861,125 | 1/1975 | Hagemeister | 248/99 |
| 4,445,658 | 5/1984 | Ferron | 248/100 |
| 4,458,867 | 7/1984 | Malik | 248/97 |
| 4,487,388 | 12/1984 | Provan | 248/99 |
| 4,613,104 | 9/1986 | Garrott | 248/97 |
| 4,638,968 | 1/1987 | Auten | 248/97 |
| 4,760,983 | 8/1988 | McNerney | 248/100 |
| 5,190,253 | 3/1993 | Sable | 248/907 |
| 5,397,085 | 3/1995 | Spagnolo | 248/97 |

FOREIGN PATENT DOCUMENTS

| | | | |
|---|---|---|---|
| 1178914 | 12/1984 | Canada | 201/61 |
| 1431508 | 1/1966 | France | 248/97 |
| 1021125 | 7/1964 | United Kingdom | 248/95 |

*Primary Examiner*—Leslie A. Braun
*Assistant Examiner*—Willie W. Berry, Jr.
*Attorney, Agent, or Firm*—McFadden, Fincham

[57] ABSTRACT

This invention provides a supporting structure for supporting different types of flexible containers or bags. Structure is capable of supporting open-mouth type bags and in addition can support handle-type bags or t-shirt bags. The supporting structure includes a retaining arrangement for retaining the mouth of the flexible container open under tension and members are provided for restraining lateral movement of a container mounted in the device. A bag bottom supporting arrangement for supporting the bottom of the flexible container is provided and the bag supporting arrangement is movably mounted to the structure for movement between a first supporting position where the bottom of the bag is supported to a collapsed position where the bottom supporting apparatus is folded upwardly and into the structure. This results in a compact arrangement which is advantageous for storage purposes as well as shipping the article.

9 Claims, 3 Drawing Sheets

COLLAPSIBLE SUPPORT STRUCTURE FOR FLEXIBLE BAGS

FIELD OF THE INVENTION

The present invention is directed to a supporting structure for flexible containers. More particularly, the present invention relates to a collapsible supporting frame for retaining refuse bags in an upright open position.

BACKGROUND OF THE INVENTION

The art has previously proposed a plethora of flexible bag holders, typical of which is U.S. Pat. No. 5,190,253, issued to Sable, Mar. 2, 1993. The holder includes two pivotally mounted arms for holding the handles of conventional t-shirt bags. The patentee provides a platform which is pivotally mounted at the bottom of the holder for supporting the bag bottom. The arms are mounted such that they are pivotally moveable inwardly towards the rear wall of the apparatus while the platform is moveable upwardly for the collapse of the structure.

This arrangement is useful for light use, however, it would appear that the structure is limited where the flexible bag supported thereon would be filled with heavier refuse, due to the positioning of the platform and the open ended arms for supporting the handles of the bag. Under heavy weight conditions, it would appear that the arrangement set forth in the Sable reference may result in a full bag simply bending the platform and subsequently resulting in the disengagement of the arms from the handle. This would appear to be particularly disadvantageous since such bag holders are often positioned on the inside of a cupboard door and accordingly, under rotation, the possibility of slippage or loss of the bag is even greater. In view of these limitations, it would be desirable to have a collapsible holder which additionally ensured positive engagement of the flexible bag to prevent inadvertent spillage or otherwise disengagement of the bag from the holder.

SUMMARY OF THE INVENTION

One object of the present invention is to provide an improved flexible bag holder, which holder is additionally collapsible.

A further object of the present invention is to provide a supporting structure for flexible containers comprising: a first body member including: retaining means for retaining the open mouth of a flexible container open under tension; means for restraining lateral movement of a container mounted in the structure; first rear frame means for supporting and mounting the first body member; a second body member connected to the first body member, the second body member including: moveable flexible container bottom supporting means for supporting the bottom of the flexible container, the bottom supporting means including second rear frame means movably mounted to the first body member for movement from a bag supporting position to a collapsed position; and second lateral restraint means for restraining lateral movement of the bag bottom.

Due to the design of the bag holder according to the present invention, the same is capable of maintaining positive engagement with a flexible bag even when the same is overfilled or filled with wet heavy refuse.

By providing a two-piece body and particularly a moveable bag supporting member, which bag supporting member provides the lateral restraint and forward restraint, the holder has utility even with an overfilled bag.

In addition to the above, the bag supporting means may additionally include a rearwardly extending rolled bag holder for holding a supply of rolled bags. This arrangement has a further advantage in that under load conditions, the rearwardly extending rolled bag holder is configured to receive some of the weight and therefore alleviates the load realized by the retaining member for maintaining the mouth of the bag in an open condition. Auxiliary substrate mounting means contribute to the stability of the arrangement.

It has been found that providing the pivotable connection between the second body and first body members at the first and second rear frame members, that one can avoid the inherent bending problems of the frame under load as those which would be attributed to an arrangement where the bag supporting means simply provided an outwardly extended plate pivotally connected at a rearward point on the frame. As will be realized by those skilled, the concentration of all of the force of the weight at the rearward pivoting point in, for example, the platform disposition as set forth in U.S. '253, will inherently result in the bending of the platform and thus the loss of support of the bag from the holder.

The device of the present invention can be made from various types of materials and in various forms. Preferably, the device is made of metal wire, or suitable plastic rod. In the case of forming the device from metal wire, the same may be coated with a plastic material. Bars or strips can be used to form the structure, being suitably welded/joined where appropriate. In manufacturing the device, the structure may be merely stacked from the appropriate sheet material or in the case of the wire rods, formed on wire-forming machines.

Different sizes of the device may be constructed according to conventional practices to accommodate sizes of bags.

In the structure of the present invention, the retaining means which function to mount the open-mouth bags is preferably partially flexible so as to permit a mouth of a bag to be stretched across the retaining means and maintain the open-mouth under tension. Thus, the retaining means may be resilient due to the provision of a U-shaped engaging means in the retaining means for the handle type bags that a user may compress the retaining means slightly to mount the mouth of the bag thereabout and when mounted, due to the nature of the resilient material, to stretch the mouth of the bag.

Having thus generally described the invention, reference will now be made to the accompanying drawings.

Figure 1:
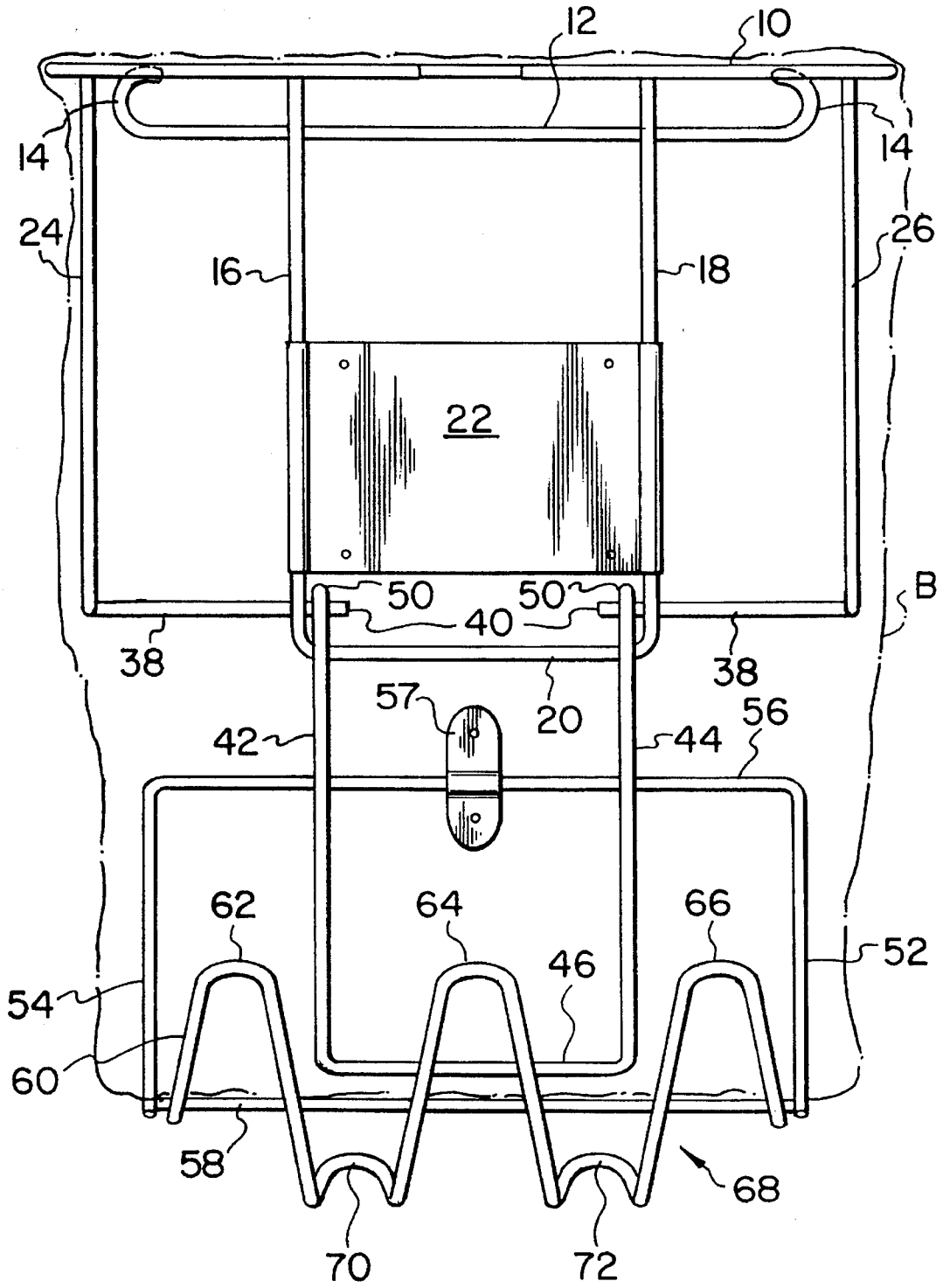
FIG. 1 is a front elevational view of one embodiment of the present invention.

Referring now in greater detail to the drawings, the support structure of the present invention, in one example, illustrated from the front is shown in FIG. 1 and suppors bag, B. It will be noted from FIG. 1, the support structure is generally of an open frame type configuration and has retaining means 10 comprising an upper horizontal open hexagonal member of a discontinuous nature.

A cross-member 12 has upwardly and outwardly extending lateral free end portions 14. The free end portions 14 may be used as a hinge or pivot points if desired to include a lid or top cover over the support structure. In such a case, the lid (not shown) would be provided with appropriate apertures for insertion of the free-end portions 14 so that the lid could be moved pivotally between open and closed positions.

Cross member 12 is maintained in a vertically spaced relationship with the retaining means 10 and is connected to a pair of vertically extending rear frame members 16 and 18, which frame members 16 and 18 are connected at one end with a cross-member 20. In this manner, the rear frame members together form a U-shaped support structure.

Mounting means such as a rear plate 22 may be provided between rear frame members 16 and 18 for mounting the structure onto a substrate surface, such as a wall or cupboard door (not shown).

Extending vertically adjacent each side of retaining means 10, lateral bag restraining means 24 and 26 are provided. Each extends for contact with the restraining means 10.

Figure 2:
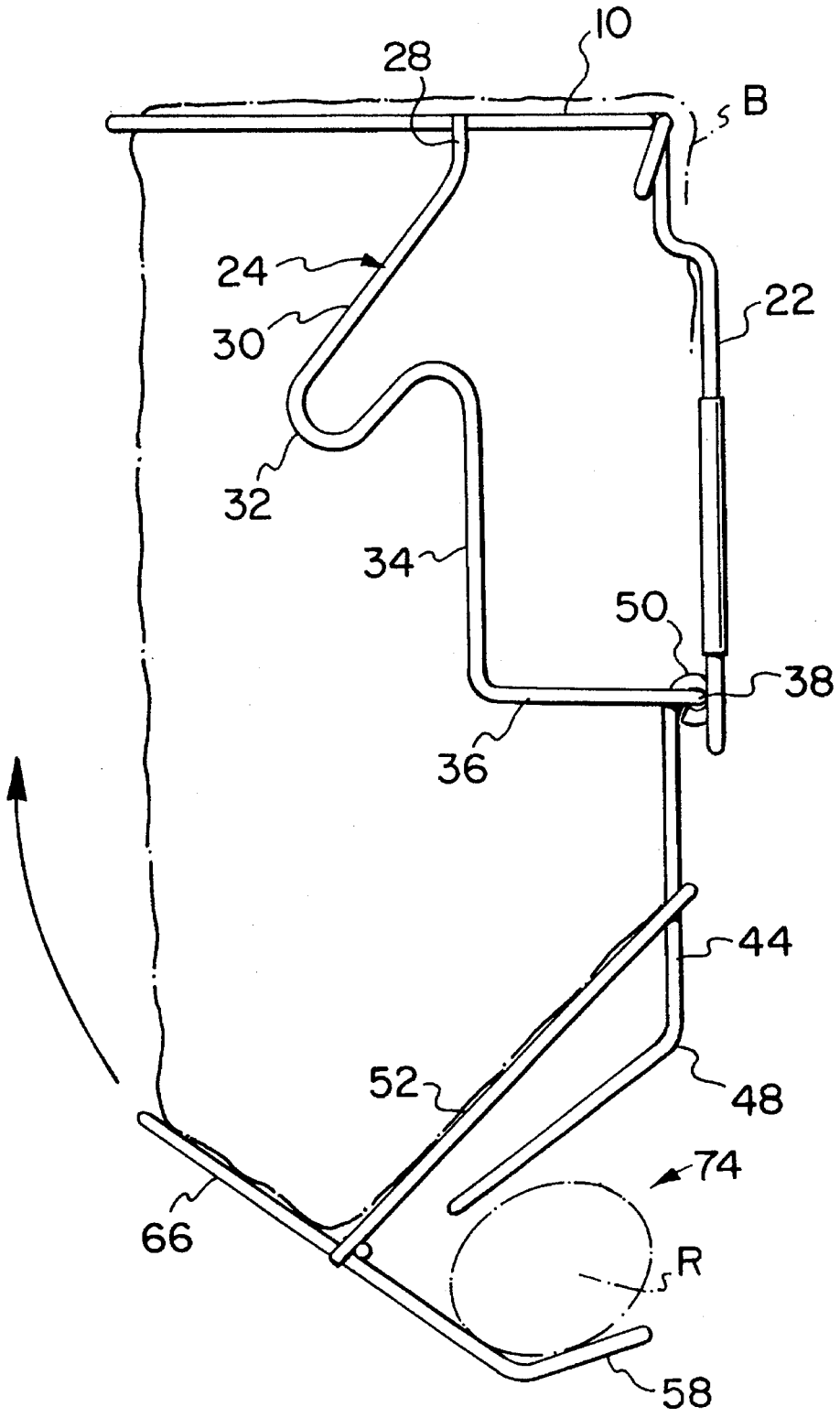
FIG. 2 is a side elevational view of the embodiment illustrated in FIG. 1.
Figure 3:
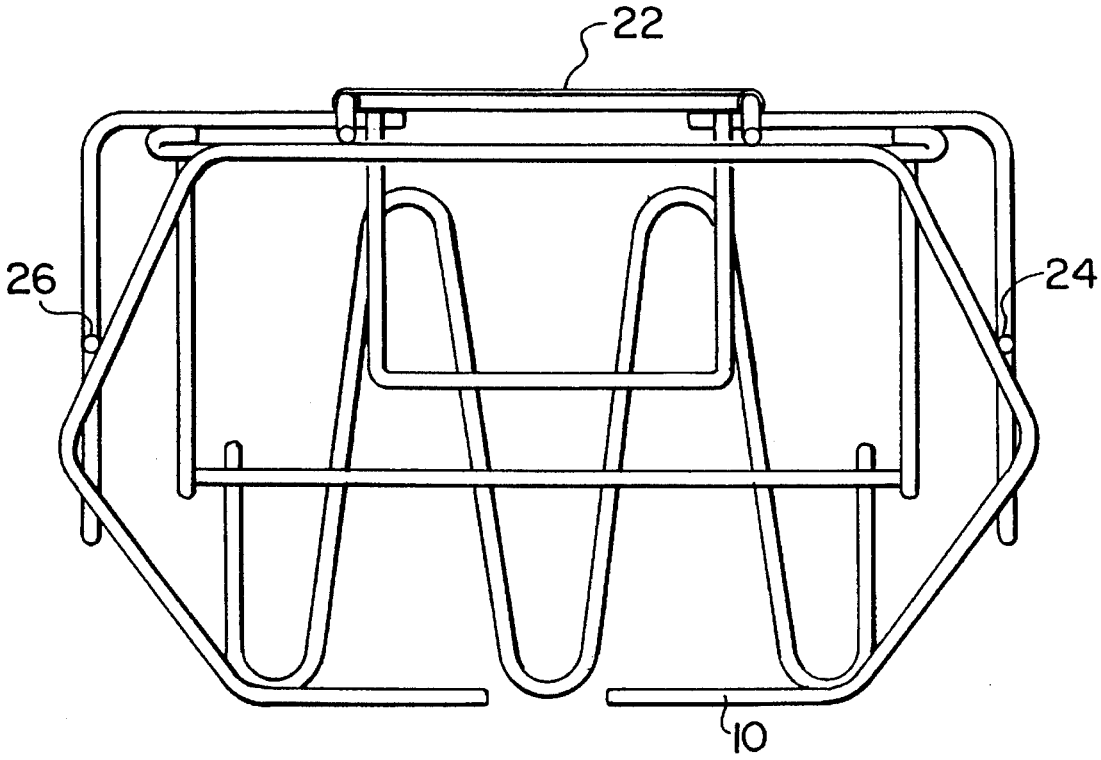
FIG. 3 is a top-plan view of the FIG. 1 embodiment.

Referring now to FIG. 2, the lateral restraining means 24 is shown in greater detail. Although the description will be limited to restraint 24, it will be appreciated that although only one such restraint is illustrated, the same features will be ascribable to restraint 26 of FIG. 1.

The lateral restraint 24 includes an upwardly extending generally vertical segment 28 which contacts for connection the retaining means 10. The segment 28 includes a diagonally oriented segment 30, which segment further leads to a generally S-shaped handle engaging member 32. The S-shaped member 32 further provides a generally vertical segment 34 which segment is coplanar with segment 28. A lateral segment 36, which is parallel with retaining means 10 is provided and further includes an orthoginal straight segment 38 having a free end 40. Each of the segments 38 provided for on members 24 and 26 extend for contact with and project beyond rear frame members 16 and 18 such at the free ends 40 of members 38 extend within the U-shaped frame work.

Having thus generally described the first body member, reference will now be made to the second body member which is movably connected to the first body member for movement in the direction of the arrow shown in FIG. 2.

The second body member includes a generally U-shaped rear frame which includes generally vertically extending rear frame members 42 and 44 with the ends of members 42 and 44 being connected by a frame member 46 extending therebetween. Each of the members 42 and 44 includes a bend 48 intermediate the ends while the upper ends each include an eyelet or ring 50, which rings 50 receive free ends 40 of the frame members 38.

The second body member further includes bag bottom support means with the body including lateral restraint members 52 and 54. Members 52 and 54 are generally angularly inclined relative to rear frame members 42 and 44, the relationship being illustrated in side elevational view in FIG. 2. Members 52 and 54 are joined at their ends by upper cross member 56 and a lower cross member 58. Cross member 56 includes a mounting plate 57.

To further assist in supporting the bag bottom means, the bag being indicated by B, the second body member further includes forward bag restraining means comprising a generally sinusoidal frame work 60 which is connected to lower cross member 58. The sinusoidal frame work includes at least three forwardly and outwardly projecting finger-like segments 62, 64 and 66 which assist in maintaining the bag within the structure. Extending rearwardly there is preferably provided either as an extension to frame work 60 or an individual separate frame work 68, which frame work extends upwardly and outwardly from cross-member 58. The frame work 68 may include a pair of spaced apart finger-like projections 70 and 72, which fingers 70 and 72 provide a rolled bag receiving area 74 as illustrated in FIG. 2 for storing a roll of flexible bags, the roll being shown in chain line and denoted by R.

By employing the structure as set forth herein in the description, it has been found that numerous advantages can be realized. Firstly, the positioning of the connection between the moveable body members, namely the cooperation of elements 38, 40 and 50 results in an effective load transfer experienced by the support structure under a load condition where the bag B is completely filled. By providing the disposition of the elements as set forth hereinabove, the weight that would be experienced by the lower body bag bottom support means is not as large as it would be if the point of connection between the body members were, for example, realized entirely by the forward bag restraint frame work 60. The weight transfer is further assisted by the rearwardly extending fingers 70 and 72. Under significant load conditions, the fingers 70 and 72, which would be in direct contact with a substrate to which the structure would be mounted, would reduce the amount of force experienced by the top or retaining means 10 of the structure and further that weight which would be experienced by the mounting means 22. In this manner, a certain degree of the force is additionally reduced by making use of the approximately centrally disposed point of rotation for the body members as provided for by elements 38, 40 and 50.

As a further attendant advantage of the swingable body parts, the structure has a further advantage in terms of being collapsible when not in use. In this manner, as illustrated in FIG. 2, the lower end of the structure can simply be pivoted upwardly for disposition within the confines of the area bounded by the restraint members 24 and 26.

Although embodiments of the invention have been described above, it is not limited thereto and it will be apparent to those skilled in the art that numerous modifications form part of the present invention insofar as they do not depart from the spirit, nature and scope of the claimed and described invention.

I claim:

1. A supporting structure for flexible containers comprising:

a first body member including:

retaining means for retaining an open mouth of a flexible container open under tension;

means for restraining lateral movement of the flexible container mounted in said structure;

first rear frame means for supporting and mounting said first body member;

a second body member pivotally connected to said first body member, said second body member after their width including:

moveable flexible container bottom supporting means for supporting the bottom of said flexible container, said bottom supporting means including second rear frame means movably mounted to said first body member for movement from a flexible container supporting position to a collapsed position; and second lateral restraint means for restraining lateral movement of said flexible container bottom.

2. The supporting structure as set forth in claim 1, wherein said second body member further includes forward restraint means for restraining forward movement of said bag.

3. The supporting structure as set forth in claim 1, wherein said moveable bag supporting means further includes storage means for storing a supply of flexible bags.

4. The supporting structure as set forth in claim 3, wherein said storage means comprises rearwardly extending frame members, said frame members adapted to abut a substrate to which said frame member is mounted.

5. The supporting structure as set forth in claim 1, wherein said first body member includes means for mounting said body member to a substrate.

6. The supporting structure as set forth in claim 1, wherein said second body member includes means for mounting said body member to a substrate.

7. The supporting structure as set forth in claim 1, wherein said pivotal movement is at a mid-point of said support structure.

8. The supporting structure as set forth in claim 1, wherein said support structure comprises wire.

9. The supporting structure as set forth in claim 8, wherein said wire is a coated wire.

* * * * *